US007673624B2

(12) United States Patent
Rosella, Jr.

(10) Patent No.: US 7,673,624 B2
(45) Date of Patent: Mar. 9, 2010

(54) DISK SHOOTING TOY

(75) Inventor: John Rosella, Jr., Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 708 days.

(21) Appl. No.: 11/445,891

(22) Filed: Jun. 2, 2006

(65) Prior Publication Data

US 2007/0023023 A1 Feb. 1, 2007

Related U.S. Application Data

(60) Provisional application No. 60/688,039, filed on Jun. 6, 2005, provisional application No. 60/732,775, filed on Nov. 1, 2005.

(51) Int. Cl.
*F41B 7/08* (2006.01)

(52) U.S. Cl. ..... 124/10; 124/16

(58) Field of Classification Search ..... 124/16, 124/26, 27, 10
See application file for complete search history.

(56) References Cited

U.S. PATENT DOCUMENTS

| | | | | |
|---|---|---|---|---|
| 1,463,894 | A * | 8/1923 | Jaffe | 124/10 |
| 2,598,354 | A | 5/1952 | Clauss | |
| 3,370,746 | A | 2/1968 | Haas | |
| 3,487,824 | A | 1/1970 | Profitt | |
| 3,515,114 | A | 6/1970 | Carbonneau | |
| 3,717,136 | A | 2/1973 | Gay et al. | |
| 4,016,854 | A | 4/1977 | Lehman | |
| 4,277,068 | A * | 7/1981 | Sasaki | 473/511 |
| D260,918 | S | 9/1981 | Orenstein | |
| 5,050,575 | A | 9/1991 | Killion | |
| 5,186,156 | A | 2/1993 | Clayton | |
| 5,199,410 | A | 4/1993 | Cheng | |
| 5,373,975 | A | 12/1994 | Husted | |
| 5,471,967 | A | 12/1995 | Matsuzaki et al. | |
| 5,611,322 | A | 3/1997 | Matsuzaki et al. | |
| 5,613,482 | A | 3/1997 | Thai | |
| 5,692,489 | A | 12/1997 | Swanson | |
| D390,284 | S | 2/1998 | Mak | |
| 5,782,228 | A | 7/1998 | Wu | |

(Continued)

OTHER PUBLICATIONS

Copy of an International Search Report from International Patent Application No. PCT/US06/21695, mailed Sep. 25, 2007.

*Primary Examiner*—John Ricci
(74) *Attorney, Agent, or Firm*—Kolisch Hartwell, P.C.

(57) ABSTRACT

The disclosure is directed to a disk shooting toy comprising a body, a port extending into the body and configured to permit a disk to be inserted into the body, a slot extending into the body, and a firing mechanism configured to shoot the disk out of the body through the slot. In some examples, the disk shooting toy may include a handle mechanism configured to selectively detach from the body and a trigger mechanism attached to the handle mechanism and configured to selectively engage the firing mechanism when the handle mechanism is attached to the body. In some examples, a trigger mechanism operatively connected to the body and including a trigger configured to selectively engage the firing mechanism and selectively cover the port. In some examples, the disk shooting toy may include structure configured to selectively attach a trigger mechanism to the body for selectively engaging the firing mechanism.

21 Claims, 10 Drawing Sheets

U.S. PATENT DOCUMENTS

| | | | |
|---|---|---|---|
| D412,019 | S | 7/1999 | Wu |
| 5,996,564 | A | 12/1999 | Kotowski |
| 6,015,328 | A | 1/2000 | Glaser |
| 6,116,229 | A | 9/2000 | Wu |
| 6,224,457 | B1 | 5/2001 | Wu |
| 6,343,969 | B1 | 2/2002 | Spector |
| 6,419,545 | B1 | 7/2002 | Motosoko |
| 6,733,356 | B2 | 5/2004 | Lee |
| D505,983 | S | 6/2005 | Itami et al. |
| 2001/0051488 | A1 | 12/2001 | Tachau et al. |
| 2002/0166551 | A1 | 11/2002 | Lee |
| 2003/0134562 | A1 | 7/2003 | Lee |

* cited by examiner

DISK SHOOTING TOY

RELATED APPLICATIONS

This application claims priority under 35 U.S.C. § 119(e) to U.S. Provisional Application No. 60/688,039 filed on Jun. 6, 2005, and U.S. Provisional Application No. 60/732,775 filed on Nov. 1, 2005, the disclosures of which are incorporated herein by reference for all purposes.

BACKGROUND

Disk shooting toys are a source of entertainment to persons using them. A disk shooting toy may include a body and a firing mechanism for propelling objects from the body. The body of a disk shooting toy may take various shapes, such as a gun, a vehicle, or an action figure. Firing mechanisms in a disk shooting toy may include spring operated mechanisms, motorized mechanisms, or resilient member mechanisms.

Examples of disk shooting toys are found in U.S. Pat. Nos. 2,598,354; 3,370,746; 3,487,824; 3,515,114; 3,717,136; 4,016,854; 4,277,068; 5,050,575; 5,199,410; 5,471,967; 5,611,322; 5,613,482; 5,782,228; 5,996,564; 6,116,229; 6,224,457; 6,343,969; 6,419,545; 6,733,356; D260918; D390284; D412019; D505983; and U.S. Published Applications 2002/0166551 and 2003/0134562, the disclosures of which are incorporated herein by reference for all purposes.

SUMMARY

The present disclosure is directed to a disk shooting toy comprising a body, a port extending into the body for inserting a disk, a slot operatively connected to the port and extending into the body, and a firing mechanism operatively connected to the body for shooting a disk through the slot. In some examples, the disk shooting toy may include a detachable handle mechanism. In some examples, the disk shooting toy may include a trigger mechanism having a trigger configured to selectively engage the firing mechanism and selectively cover the port. In some examples, the disk shooting toy may include a trigger mechanism selectively operable for actuating the firing mechanism and means for selectively attaching the trigger mechanism to the body.

DETAILED DESCRIPTION

Figure 1:
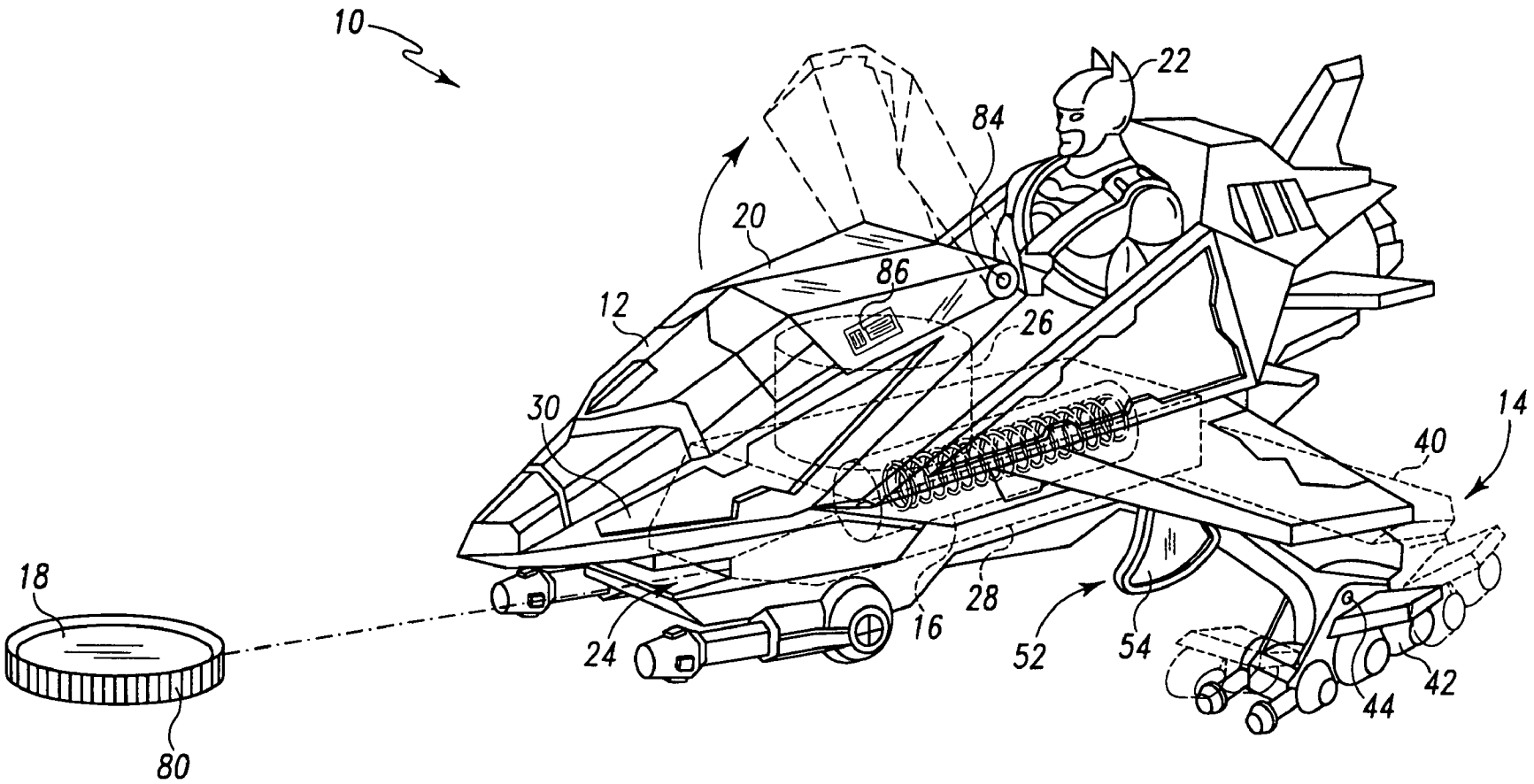
FIG. 1 is a perspective view of a disk shooting toy.

As shown in FIG. 1, a disk shooting toy 10 may include a body 12, which may resemble a vehicle, an airplane, or a spaceship. Features attached to body 12 may include a handle mechanism 14 for manipulating body 12 and a firing mechanism 16 configured to shoot or propel a disk 18 outside body 12. Optionally, disk shooting toy 10 may include a cover 20 and a pilot 22.

Pilot 22 may attach to body 12 adjacent to cover 20 such that pilot 22 appears to look through cover 20 when cover 20 is in the open position. However, it is within the scope of this disclosure that pilot 22 may attach elsewhere to body 12 or may be selectively removed from body 12 altogether.

Body 12 may include a slot 24 from which firing mechanism 16 may shoot disk 18 outside body 12. For loading disk 18 into firing mechanism 16, body 12 may include a port 26. Slot 24 and port 26 may collectively define a cavity 28 inside body 12. Firing mechanism 16 may be mounted in cavity 28, but it is within the scope of this disclosure that firing mechanism 16 may attach to an exterior surface 30 of body 12.

Figure 2:
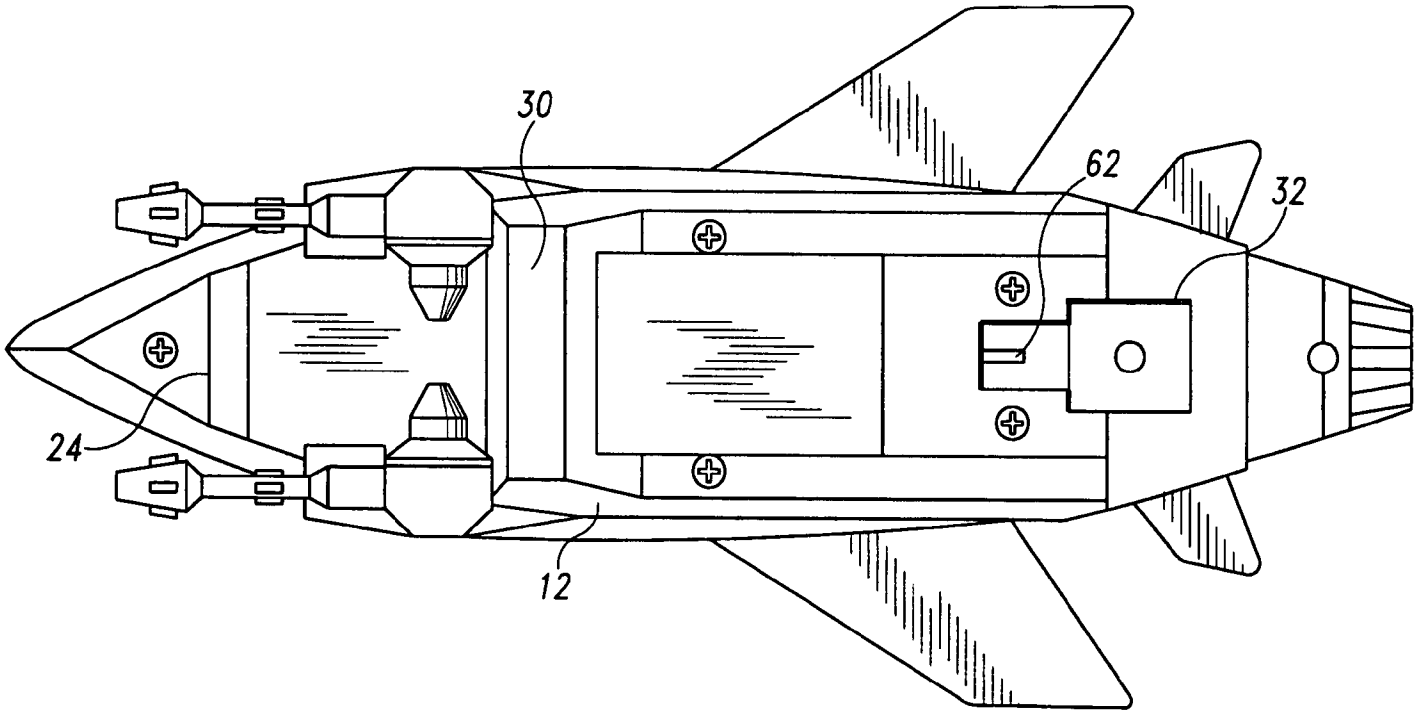
FIG. 2 is a bottom view of the disk shooting toy of FIG. 1.
Figure 3:
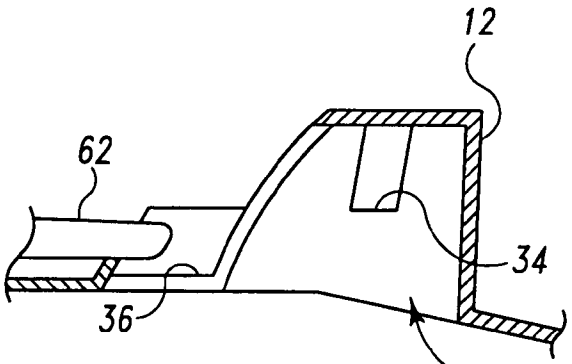
FIG. 3 is a fragmentary view of a portion of the disk shooting toy of FIG. 1 showing a handle socket.

With reference to FIG. 2, body 12 may include a handle socket 32 for receiving therein handle mechanism 14, which may be selectively detachable from and attachable to body 12. As shown in FIG. 3, handle socket 32 may include an attachment detent receiving recess 34 and a restriction detent receiving recess 36, both configured to mate with members of handle mechanism 14.

Figure 4:
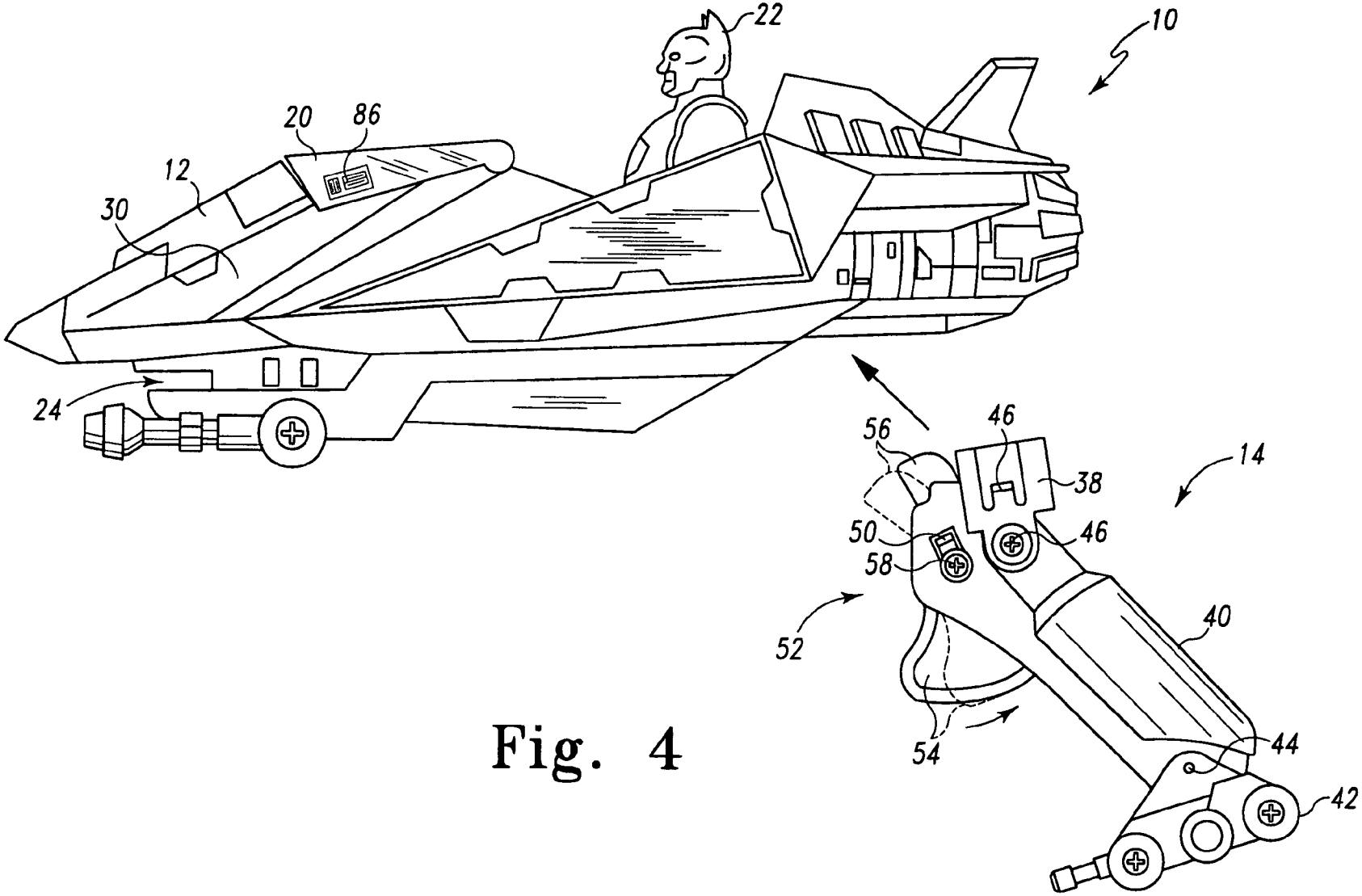
FIG. 4 is a side view of the disk shooting toy of FIG. 1 with a handle mechanism detached from a body.

As shown in FIG. 4, handle mechanism 14 may include an attachment mechanism 38 for selectively attaching handle mechanism 14 to body 12, and a handle 40. Optionally, handle mechanism 14 may include a platform assembly 42 for supporting disk shooting toy 10 in an upright position. Platform assembly 42 may pivotally attach to a distal end of handle 40 at a platform assembly pivot 44.

Attachment mechanism 38 may include an attachment detent member 46 for mating with attachment detent receiving recess 34 in handle socket 32. Mating attachment detent member 46 with attachment detent receiving recess 34 may facilitate selective attachment and detachment of handle mechanism 14 to and from body 12.

Handle 40 may be pivotally attached to attachment mechanism 38 at handle pivot 48. To restrict handle 40 from pivoting, handle 40 may include a restriction detent member 50 configured to mate with restriction detent receiving recess 36 in handle socket 32. Mating restriction detent member 50 with restriction detent receiving recess 36 may selectively restrict handle 40 from pivoting relative to attachment mechanism 38.

Disk shooting toy 10 may include a trigger mechanism 52 attached to handle mechanism 14 for engaging firing mechanism 16. Trigger mechanism 52 may include a trigger 54 and an actuator 56 attached to trigger 54. Trigger 54 may be pivotally attached to handle mechanism 14 at a trigger pivot 58. In some embodiments, trigger 54 may be configured to pivot between a cocked position and a squeezed position.

Turning to FIG. 5, firing mechanism 16 may comprise a C-shaped holder 60 for holding disk 18 and a plunger 62 for pushing disk 18 seated in C-shaped holder 60. Firing mechanism 16 may include a biasing member 64 to bias plunger 62 in a given position and may include a housing 66 to house plunger 62 and biasing member 64. In some embodiments, housing 66 may provide a platform from which biasing member 64 may exert biasing force upon plunger 62.

Figure 5A:
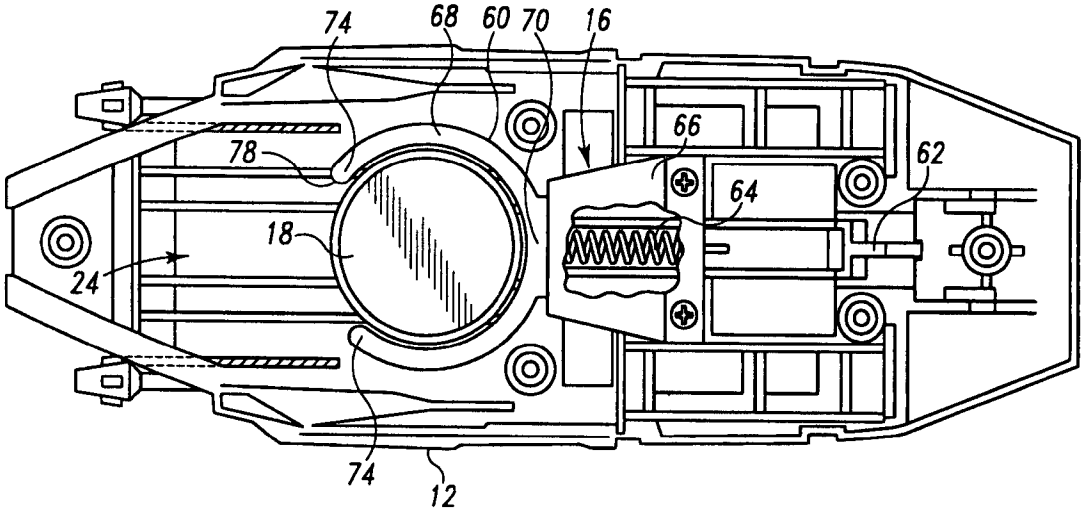
FIGS. 5A and 5B provide top views of the disk shooting toy of FIG. 1 with a top portion of the body removed.
Figure 5B:
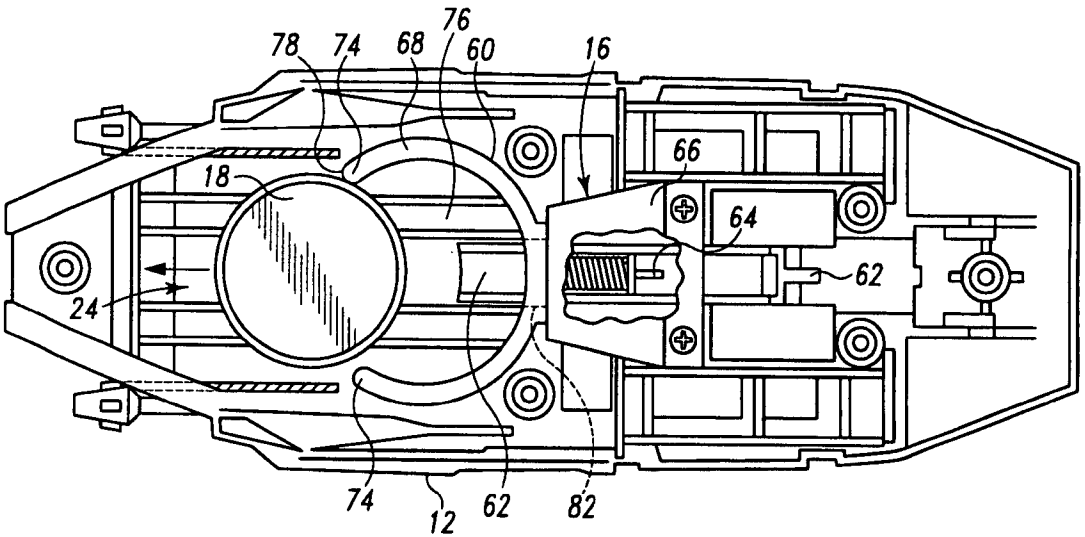

As shown in FIGS. 5A and 5B, C-shaped holder 60 may comprise curved resilient arms 68, a shoulder 70 joining curved resilient arms 68, and an opening 72 opposite shoulder 70 defined by the distal ends 74 of curved resilient arms 68. Opening 72 may be smaller than the diameter of disk 18 such that disk 18 must be forced through opening 72 to pass therethrough. Curved resilient arms 68 may define an interior 76 of C-shaped holder 60 in which disk 18 may be placed.

Curved resilient arms 68 may include a spin member 78 for imparting spin to disk 18. Spin member 78 may reside at a distal end 74 of one of curved resilient arms 68. In some embodiments, spin member 78 may include a projection projecting into interior 76 of C-shaped holder 60. In other embodiments, spin member 78 may be an extension of distal end 74 such that one curved resilient arm 68 is longer than the other. As shown in FIG. 1, disk 18 may include teeth 80 for interfacing with spin member 78.

Plunger 62 may be slidably mounted and configured to slide between a loading position and a firing position. In the loading position, depicted in FIG. 5A, plunger 62 may be disposed outside C-shaped holder 60 to facilitate loading disk 18 therein. In the firing position, depicted in FIG. 5B, plunger 62 may project into C-shaped holder 60 and push disk 18 through opening 72.

In some embodiments, shoulder 70 may include a groove 82 through which plunger 62 may slide into C-shaped holder 60. Groove 82 may form a channel defining a path in which plunger 62 may slide.

Plunger 62 pushing disk 18 through opening 72 may expand curved resilient arms 68 and store potential energy therein. When plunger 62 moves disk 18 more than approximately 50% through opening 72, curved resilient arms may retract and transfer the potential energy stored therein to disk 18. The potential energy transferred to disk 18 may convert to kinetic energy and cause disk 18 to shoot outside disk shooting toy 10 through slot 24.

Plunger 62 may abut actuator 56 when handle mechanism 14 is attached to body 12. Pivoting trigger mechanism 52 between the cocked and squeezed positions may cause actuator 56 to actuate plunger 62 between the loading and firing positions. Biasing member 64 may bias plunger 62 in the loading position.

Figure 6:
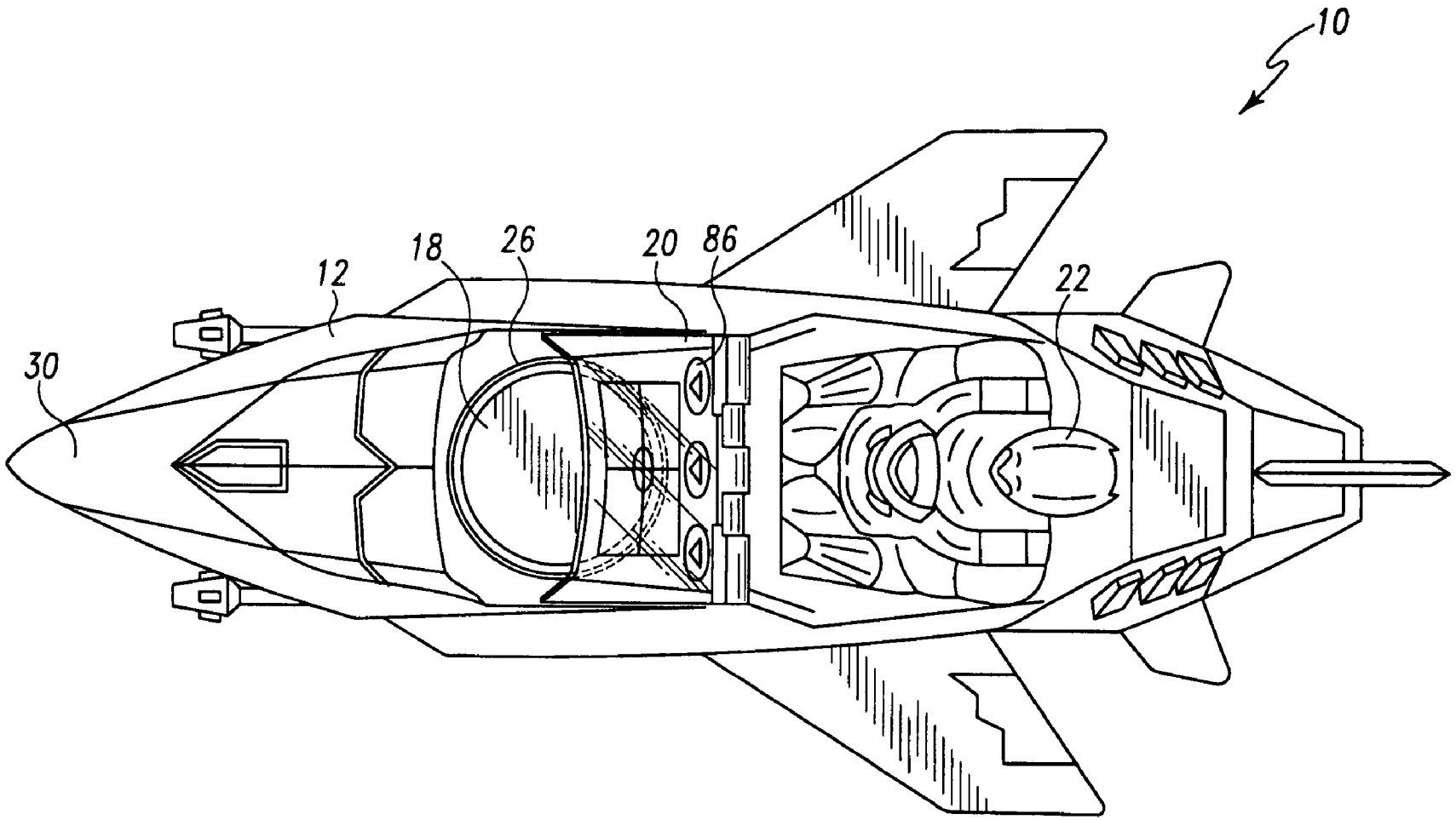
FIG. 6 is a top view of the disk shooting toy of FIG. 1.

Turning attention briefly back to FIG. 1, cover 20 may pivotally attach to body 12 at a cover pivot 84. Cover 20 may pivot between a closed position that covers port 26 and an open position that exposes port 26. As shown in FIGS. 1 and 6, cover 20 may optionally resemble a cockpit windshield by comprising a clear material with heads-up-display markings 86.

As can be seen from the above description, a disk shooting toy may include a body, a port extending into the body and configured to permit a disk to be inserted into the body, a slot operatively connected to the port and extending into the body, a firing mechanism operatively connected to the body and configured to shoot the disk out of the body through the slot, a handle mechanism configured to selectively detach from the body, and a trigger mechanism attached to the handle mechanism and configured to selectively engage the firing mechanism when the handle mechanism is attached to the body.

Further, the above description demonstrates that a disk shooting toy may include a body, a port extending into the body and configured to permit a disk to be inserted into the body, a slot operatively connected to the port and extending into the body, a firing mechanism operatively connected to the body and configured to shoot the disk out of the body through the slot, and means for selectively attaching a trigger mechanism to the body for selectively engaging the firing mechanism.

Figure 7:
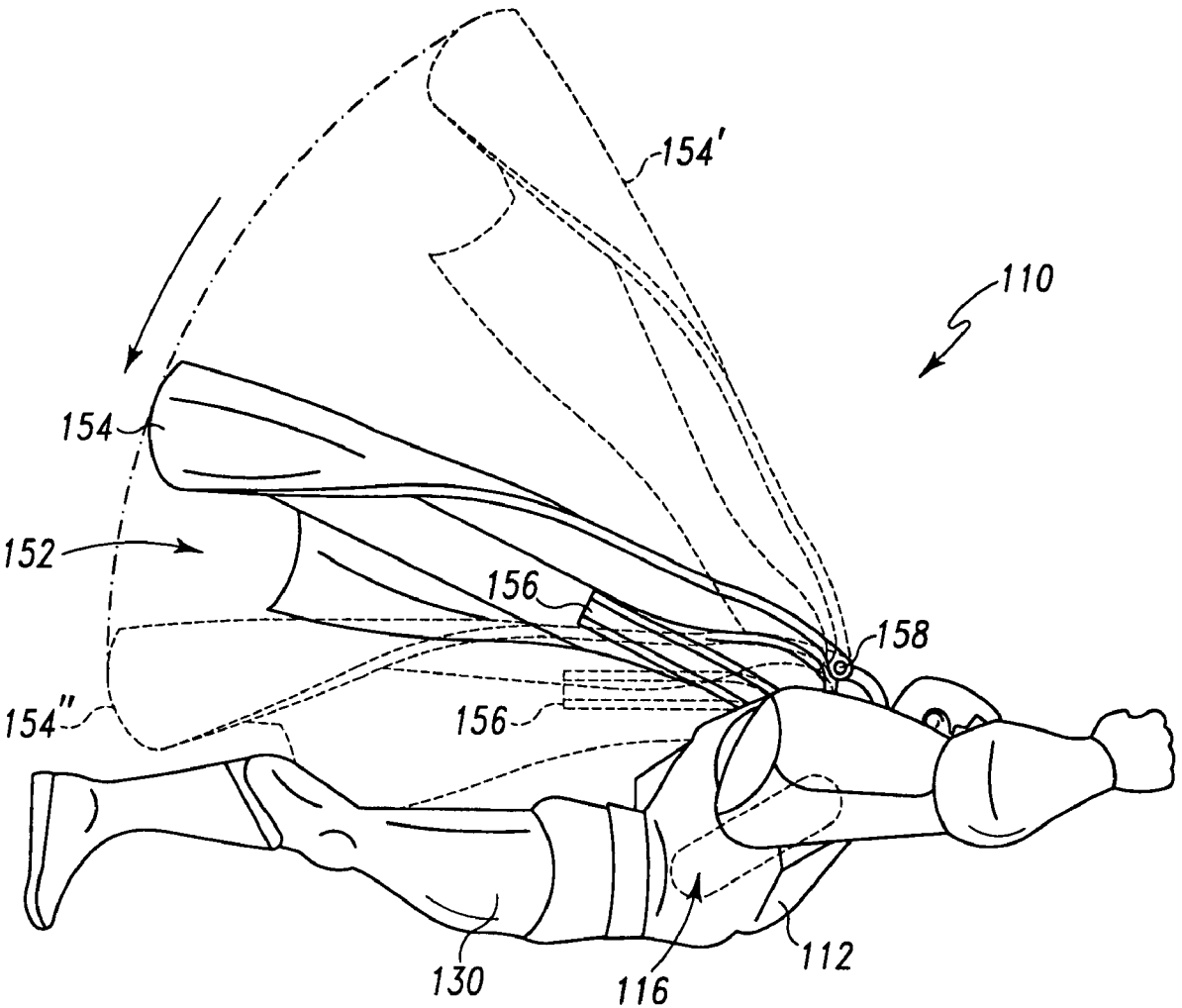
FIG. 7 is a side view of another example of a disk shooting toy.
Figure 8:
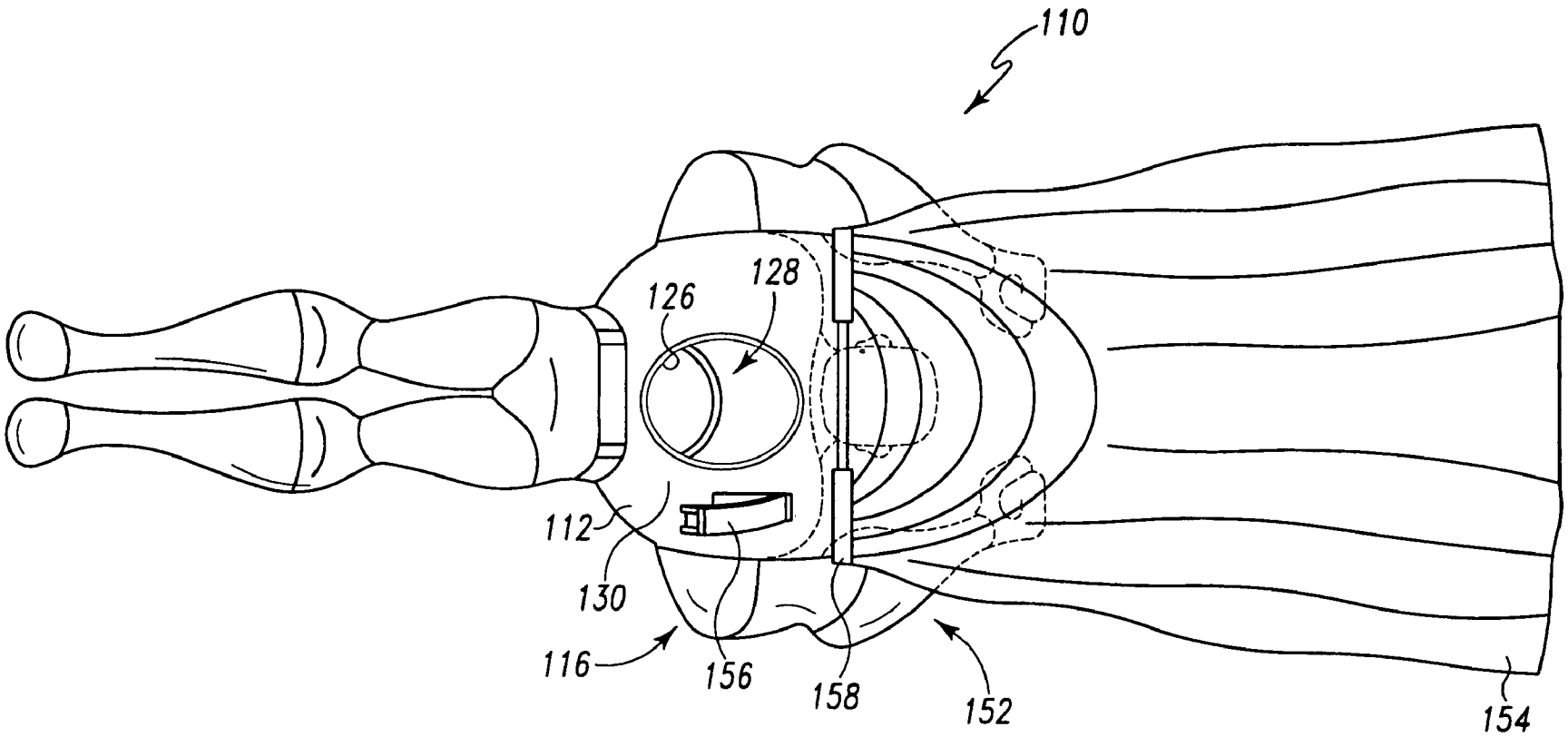
FIG. 8 is a top view of the disk shooting toy of FIG. 7.
Figure 9:
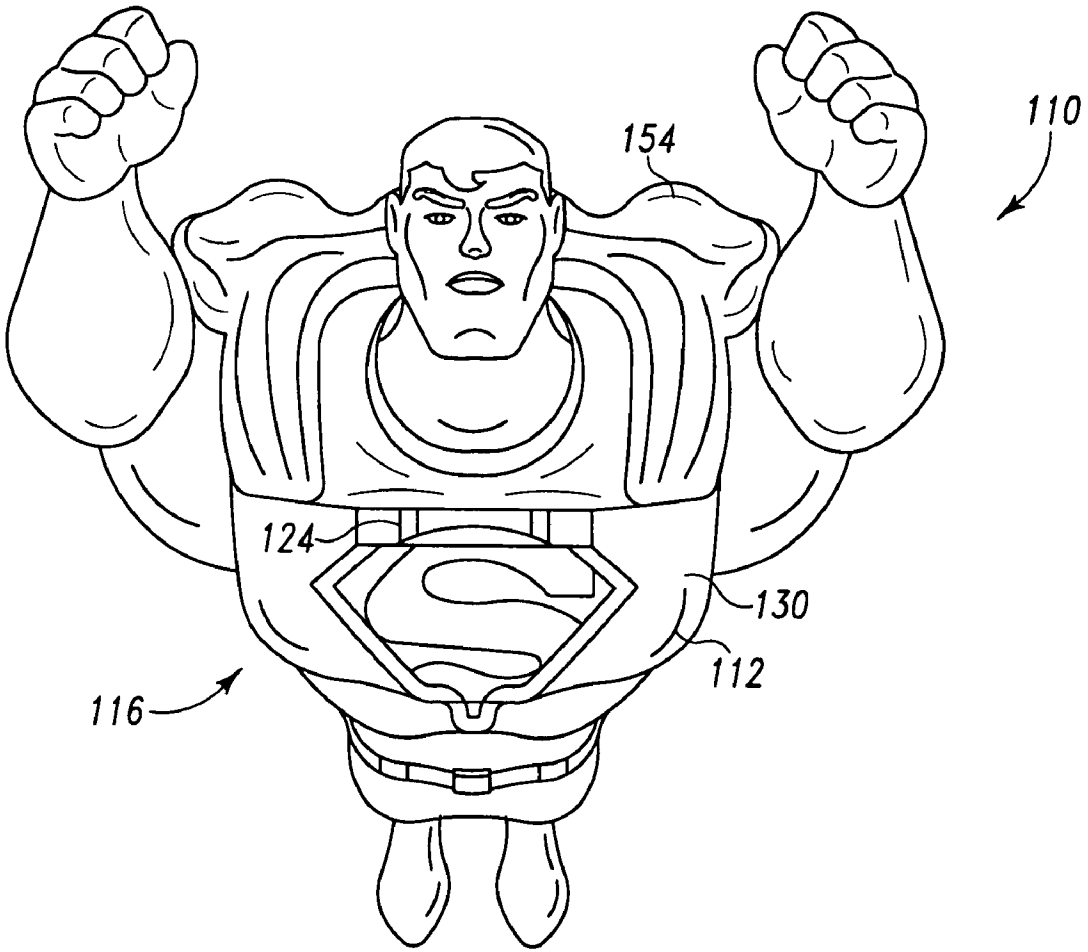
FIG. 9 is a front view of the disk shooting toy of FIG. 7.
Figure 10:
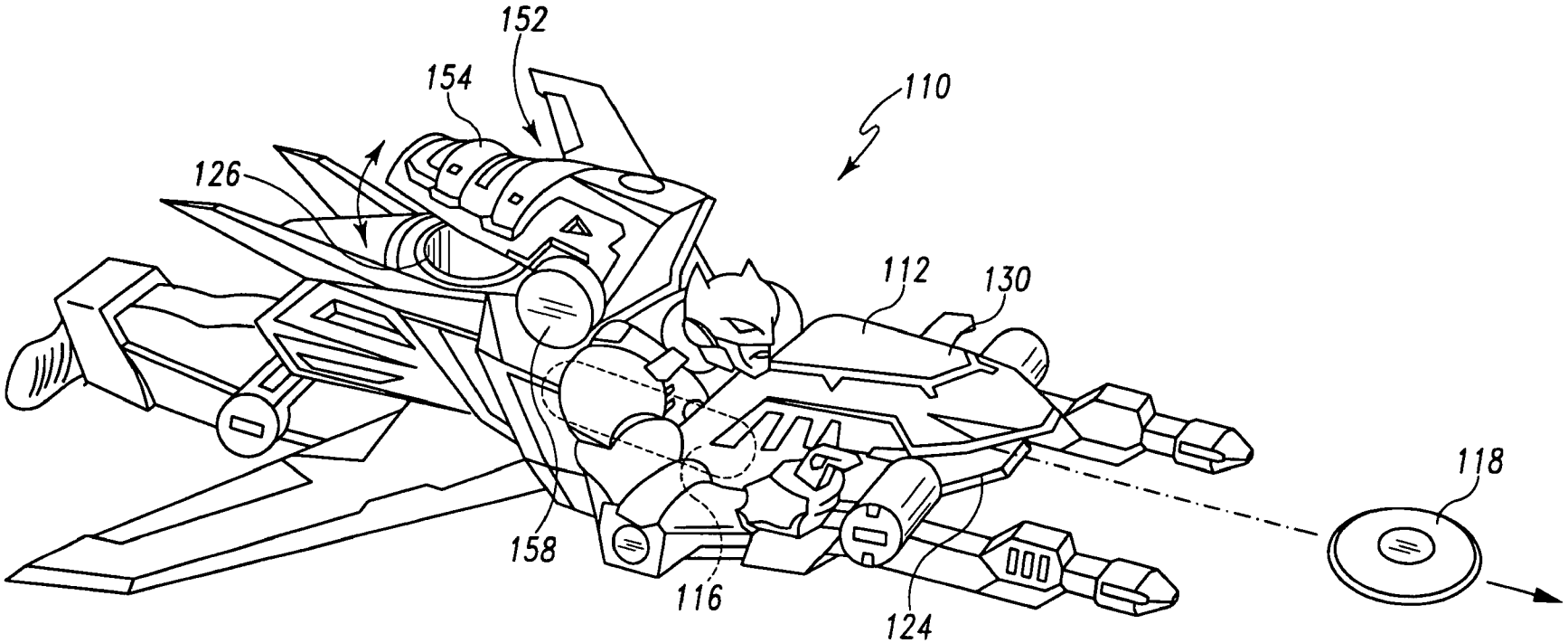
FIG. 10 is a perspective view of another example of a disk shooting toy.
Figure 11:
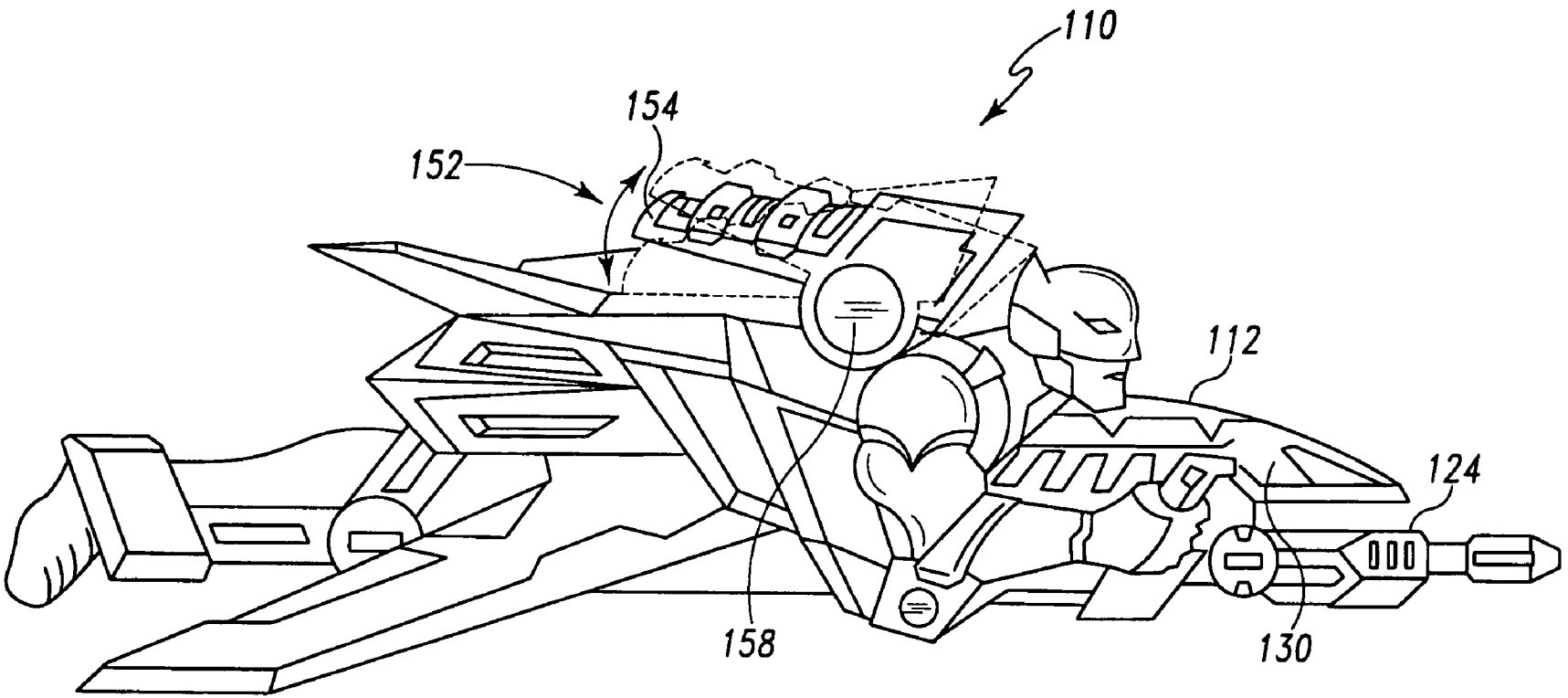
FIG. 11 is a side view of the disk shooting toy of FIG. 10.

FIGS. 7-11 illustrate other examples of a disk shooting toy 110. Features of the examples shown in FIGS. 7-11 similar to features of the example shown in FIGS. 1-6 are similarly numbered for consistency. FIGS. 7-9 show an example of disk shooting toy 110 resembling Superman with a cape and FIGS. 10-11 show an example of disk shooting toy 110 resembling Batman with a jetpack. The same figure numbers are used in each of FIGS. 7-11 to refer to the same features of disk shooting toy 110 in each example.

As shown in FIGS. 7-11, disk shooting toy 110 may include a body 112, a firing mechanism 116, and a trigger mechanism 152. Disk shooting toy 110 may take the form of an action figure, such as Superman or Batman, or it may take other forms, such as a vehicle or a gun.

Body 112 may include a slot 124 from which firing mechanism 116 may shoot disk 118 outside body 112 as shown in FIG. 10. For loading disk 118 into firing mechanism 116, body 112 may include a port 126. Slot 124 and port 126 may collectively define a cavity 128 inside body 112. Firing mechanism 116 may be mounted in cavity 128, but it is within the scope of this disclosure that firing mechanism 116 may attach to an exterior surface 130 of body 112.

Disk shooting toy 110 may include a firing mechanism 116 configured to shoot disk 118 from body 112, that is substantially the same as that described for disk shooting toy 20. Accordingly, only a brief description of firing mechanism 116 need be given.

Firing mechanism 116 may attach to body 112 inside cavity 128. Firing mechanism 116 may be disposed beneath port 126 to receive disk 118 passing through port 126 from outside body 112. Furthermore, firing mechanism 116 may be disposed adjacent to slot 124 to propel disk 118 through slot 124 when activated. As discussed above, firing mechanism 116 may include a C-shaped holder, a plunger, and a biasing member.

Disk shooting toy 110 may include a trigger mechanism 152 attached to body 112 for engaging firing mechanism 116. Trigger mechanism 152 may include a trigger 154 pivotally attached to body 112 at trigger pivot 158. An actuator 156 may pivotally attach to body 112 in the pivotal path of trigger 154. Trigger mechanism 152 may be disposed adjacent to firing mechanism 116 such that actuator 156 abuts the plunger in firing mechanism 116.

As shown most clearly in the FIG. 7 side view of disk shooting toy 110, actuator 156 may move between a rest position (shown in solid lines) and an actuation position (shown in dashed lines). As described above, the firing mechanism plunger may move between a loading position outside the C-shaped holder and a firing position inside the C-shaped holder. With regard to actuator 156, in the rest position, actuator 156 may abut the plunger as it resides in the loading position. During movement of actuator 156 from the rest position to the actuation position, actuator 156 may move the plunger to the firing position.

Trigger 154 may be configured to serve multiple functions. One function may be covering port 126 to retain disks 118 therein. Another function may be triggering firing mechanism 116 to shoot a disk 118. Trigger 154 may also be configured to serve additional or alternative functions.

As shown most clearly in FIG. 7, covering port 126 may occur when trigger 154 is pivoted from a first position (shown in dashed lines as trigger 154') to a second position (shown in solid lines as trigger 154). In the first position, trigger 154 may be positioned away from port 126 such that a user may load disk 118 therein. In the second position, trigger 154 may cover port 126. Covering port 126 may help stop disks 118 from falling out of port 126 when disk shooting toy 110 is manipulated during use.

Triggering firing mechanism 116 to shoot disk 118 may occur when trigger 154 is pivoted between the second position and a third position (shown in dashed lines as trigger 154" in FIG. 7). In the second position, in addition to covering port 126, trigger 154 may contact actuator 156 in the rest position as it abuts the firing mechanism plunger. Pivoting trigger 154 to the third position may move actuator 156 through its range of motion to the actuation position and cause firing mechanism 116 to shoot disk 118.

Additionally or alternatively, trigger 154 may take the shape of an action figure component when body 112 takes the shape of an action figure. For example, as shown in FIGS. 7-9, trigger 154 may take the shape of a cape. In other examples, as shown in FIGS. 10 and 11, trigger 154 may take the shape of a jet pack. Additionally or alternatively, trigger 154 may take the shape of other components, such as a head, an arm, or an accessory worn by the action figure.

As can be seen from the above description, a disk shooting toy may include a body, a port extending into the body and configured to permit a disk to be inserted into the body, a slot operatively connected to the port and extending into the body, a firing mechanism operatively connected to the body and configured to shoot the disk out of the body through the slot, and a trigger mechanism operatively connected to the body and including a trigger configured to selectively engage the firing mechanism and selectively cover the port.

While embodiments of a disk shooting toy and methods of operating a disk shooting toy have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure. An appreciation of the availability or significance of claims not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed.

Where "a" or "a first" element or the equivalent thereof is recited, such recitations include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

Inventions embodied in various combinations and subcombinations of features, functions, elements, and/or properties may be claimed through presentation of claims in a related application. Such claims, whether they are directed to different inventions or directed to the same invention, whether different, broader, narrower or equal in scope to the other claims, are also regarded as included within the subject matter of the present disclosure.

What is claimed is:

1. A disk shooting toy comprising:

a body;

a port extending into the body and configured to permit a disk to be inserted into the body;

a slot operatively connected to the port and extending into the body;

a firing mechanism operatively connected to the body and configured to shoot the disk out of the body through the slot;

a handle mechanism configured to selectively detach from the body, the handle mechanism including a handle and an attachment mechanism operatively connected to the handle and configured to selectively attach the handle mechanism to the body; and a trigger mechanism attached to the handle mechanism and configured to selectively engage the firing mechanism when the handle mechanism is attached to the body;

wherein the body includes a handle socket configured to receive the attachment mechanism when inserted therein, and wherein the attachment mechanism includes an attachment detent member configured to engage an attachment detent member receiving recess in the handle socket.

2. The disk shooting toy of claim 1, wherein the firing mechanism further comprises:

a C-shaped holder including two curved resilient arms extending in a C-shape and joined together at a shoulder, the C-shaped holder having an opening opposite the shoulder and sized to receive a disk;

a plunger slidably mounted and configured to slide between a loading position outside the C-shaped holder and a firing position inside the C-shaped holder; and a biasing member configured to bias the plunger to the loading position.

3. The disk shooting toy of claim 2, wherein the plunger is configured to slide through a groove formed in the shoulder substantially opposite the opening in the C-shaped holder when sliding between the loading position and the firing position.

4. The disk shooting toy of claim 2, wherein the opening is smaller than the diameter of the disk.

5. The disk shooting toy of claim 2, wherein one of the curved resilient arms includes a spin member configured to impart spin to the disk.

6. The disk shooting toy of claim 5, wherein the spin member is an appendage projecting from the C-shaped holder near the opening.

7. The disk shooting toy of claim 5, wherein the spin member is an extension of one of the curved resilient arms.

8. The disk shooting toy of claim 2, wherein the trigger mechanism includes:

a trigger configured to move between a cocked position and a squeezed position; and an actuator attached to the trigger and configured to move the plunger between the loading position and the firing position when the trigger pivots between the cocked position and the squeezed position.

9. The disk shooting toy of claim 1, wherein the trigger mechanism further comprises:

a trigger pivotally attached to the handle mechanism and configured to pivot between a cocked position and a squeezed position; and an actuator attached to the trigger and configured to engage the firing mechanism when the handle mechanism is attached to the body.

10. The disk shooting toy of claim 1, wherein the handle is pivotally attached to the attachment mechanism.

11. The disk shooting toy of claim 10, wherein the handle mechanism includes a restriction detent member operatively connected to the handle and configured to restrict the handle from pivoting relative to the attachment mechanism by engaging a restriction-detent-receiving recess in the handle socket.

12. The disk shooting toy of claim 1, wherein the handle mechanism includes a handle and a platform assembly pivotally mounted on a distal end of the handle to stabilize the disk shooting toy when the disk shooting toy is in an upright orientation and the platform assembly is positioned on an external surface.

13. The disk shooting toy of claim 1, further comprising a cover pivotally attached to the body, wherein the cover is configured to pivot between a closed position that covers the port and an open position that exposes the port.

14. A disk shooting toy comprising:

a body;

a port extending into the body and configured to permit a disk to be inserted into the body;

a slot operatively connected to the port and extending into the body;

a firing mechanism operatively connected to the body and configured to shoot the disk out of the body through the slot, the firing mechanism further including:

a holder including two curved resilient arms extending in a C-shape and joined together at a shoulder, the C-shaped holder having an opening opposite the shoulder and sized to receive a disk;

a plunger slidably mounted and configured to slide between a loading position outside the C-shaped holder and a firing position inside the C-shaped holder; and a biasing member configured to bias the plunger to the loading position; and a trigger mechanism operatively connected to the body and including a trigger mounted to the body in a position to selectively engage the firing mechanism and to selectively cover the port;

wherein the trigger is configured to pivot between a first position in which the trigger is pivoted away from the port such that a disk may be placed inside the port and a second position in which the trigger is pivoted toward the port until it at least partially covers the port.

15. The disk shooting toy of claim 14, wherein the plunger is configured to slide through a groove formed in the shoulder substantially opposite the opening in the C-shaped holder when sliding between the loading position and the firing position.

16. The disk shooting toy of claim 14, wherein one of the curved resilient arms includes a spin member configured to impart spin to a disk passing thereby.

17. The disk shooting toy of claim 16, wherein the spin member is an appendage projecting into the C-shaped holder near the opening.

18. The disk shooting toy of claim 16, wherein the spin member is an extension of one of the curved resilient arms.

19. The disk shooting toy of claim 14, wherein the trigger mechanism further comprises an actuator pivotally attached to the body, the actuator being configured to actuate the plunger between the loading position and the firing position by pivoting between a rest position, wherein the actuator abuts the plunger in the loading position, and an actuation position, wherein the actuator abuts the plunger in the firing position.

20. A disk shooting toy comprising:

a body defining a cavity and a slot forming a passageway to the cavity;

a firing mechanism mounted to the body in the cavity and configured to shoot a disk out of the body through the slot; the firing mechanism including:

a C-shaped holder including two resilient arms joined at a shoulder and defining an opening opposite the shoulder, a plunger mounted to move between:

a loading position outside the C-shaped holder that allows the disk to be loaded into the C-shaped holder, and a firing position inside the C-shaped holder that pushes the disk out of the C-shaped holder without the plunger acting on the C-shaped holder; and a biasing member configured to bias the plunger to the loading position.

21. The disk shooting toy of claim 20, wherein the shoulder defines a groove through which the plunger moves between the loading position and the firing position.

* * * * *